United States Patent [19]

Reed

[11] Patent Number: 4,804,045

[45] Date of Patent: Feb. 14, 1989

[54] OIL AND GAS WELL DIVERSIONARY SPOOL ASSEMBLY

[76] Inventor: Lehman T. Reed, 3219 Candlewood Dr., Bakersfield, Calif. 93306

[21] Appl. No.: 927,576

[22] Filed: Nov. 6, 1986

[51] Int. Cl.[4] ..... E21B 33/03; E21B 34/02

[52] U.S. Cl. ..... 166/65.1; 166/76; 166/97.5; 166/313; 166/379

[58] Field of Search ..... 166/65.1, 67, 70, 75.1, 166/76, 79, 97.5, 313, 377, 378, 379, 82

[56] References Cited

U.S. PATENT DOCUMENTS

| | | | |
|---|---|---|---|
| 3,299,958 | 1/1967 | Todd | 166/89 |
| 3,489,439 | 1/1970 | Word, Jr. | 166/89 |
| 3,638,732 | 2/1972 | Huntsinger et al. | 166/65.1 |
| 4,071,085 | 1/1978 | Grable et al. | 166/88 |
| 4,491,176 | 1/1985 | Reed | 166/66.4 |
| 4,627,489 | 12/1986 | Reed | 166/65.1 |

*Primary Examiner*—Jerome Massie
*Assistant Examiner*—Terry Lee Melius
*Attorney, Agent, or Firm*—William C. Babcock

[57] ABSTRACT

A diversionary spool assembly for the completion hook up of any type of oil and gas well without the use of an expensive and cumbersome valve tree as a permanent part of the producing well. A single valve tree is provided, and is removably mounted on any one of a group of wells provided with diversionary spool assemblies only when a particular well in that group requires maintenance or remedial work to be performed thereon.

Each diversionary spool assembly includes a rigid body having at least first and second passages therein, which body is operatively mounted on a tubing hanger supporting casing head for the first passage to be vertically aligned with a vertical bore in the tubing hanger and a tubing string that depends from the latter.

The first passage in the normal operation of the well has a plug removably and sealingly disposed therein. A bonnet is removably secured to the body by bolts, which bolts are also capable of removably securing the anchor flange of a valve tree to the body to permit maintenance and remedial work to be performed on the well when the plug is removed from the first passage. When the remedial and maintenance work has been completed, the valve tree is removed from the body, the plug inserted in the first passage, the bonnet secured to the body, and the well returned to production.

15 Claims, 5 Drawing Sheets

OIL AND GAS WELL DIVERSIONARY SPOOL ASSEMBLY

REFERENCE TO RELATED APPLICATIONS

Application Ser. No. 666,291 filed Oct. 29, 1984 entitled "Top Entry Electrical Transmission Assembly for Submersible Pumps".

BACKGROUND OF THE INVENTION

In the past the completition hook-up of an oil and gas well involved a tree array of valves being operatively mounted on the well head to not only control the operation of the well in a safe manner but to permit remedial work to be performed on the well when the occassion so required. Tree array of valves referred to as 'christmans tree' in the oil fields are not only complicated, cumbersome and expensive, but due to corrosion may deteriorate to the point that they have to be replaced prior to the termination of the production lives of the wells with which they are associated.

A primary object of the present invention is to provide a diversionary spool assembly that is operatively associated with the casing head of an oil and gas well to control the production of fluid therefrom, and without the use of a christmas tree array of valves, all at a substantial saving to the operator of the well.

Another object of the invention is to not only provide a diversionary spool assembly having not only the above mentioned operational advantages, but one that is adapted when the occassion so requires to have a christmas tree array of valves removably secured thereto to permit remedial work to be performed on the well.

A still further object of the invention is to furnish a diversionary spool assembly of such design and structure that when each well in a group thereof is provided with one, a single working christmas tree may be secured to any desired one of the diversionary spools to permit maintenance work to be performed on the well associated therewith, with the working christmas tree being separated from the well after the maintenance work is performed.

These and other objects and advantages of the invention will become apparent from the following description thereof and the drawings illustrating the same.

SUMMARY OF THE INVENTION

Figure 1:
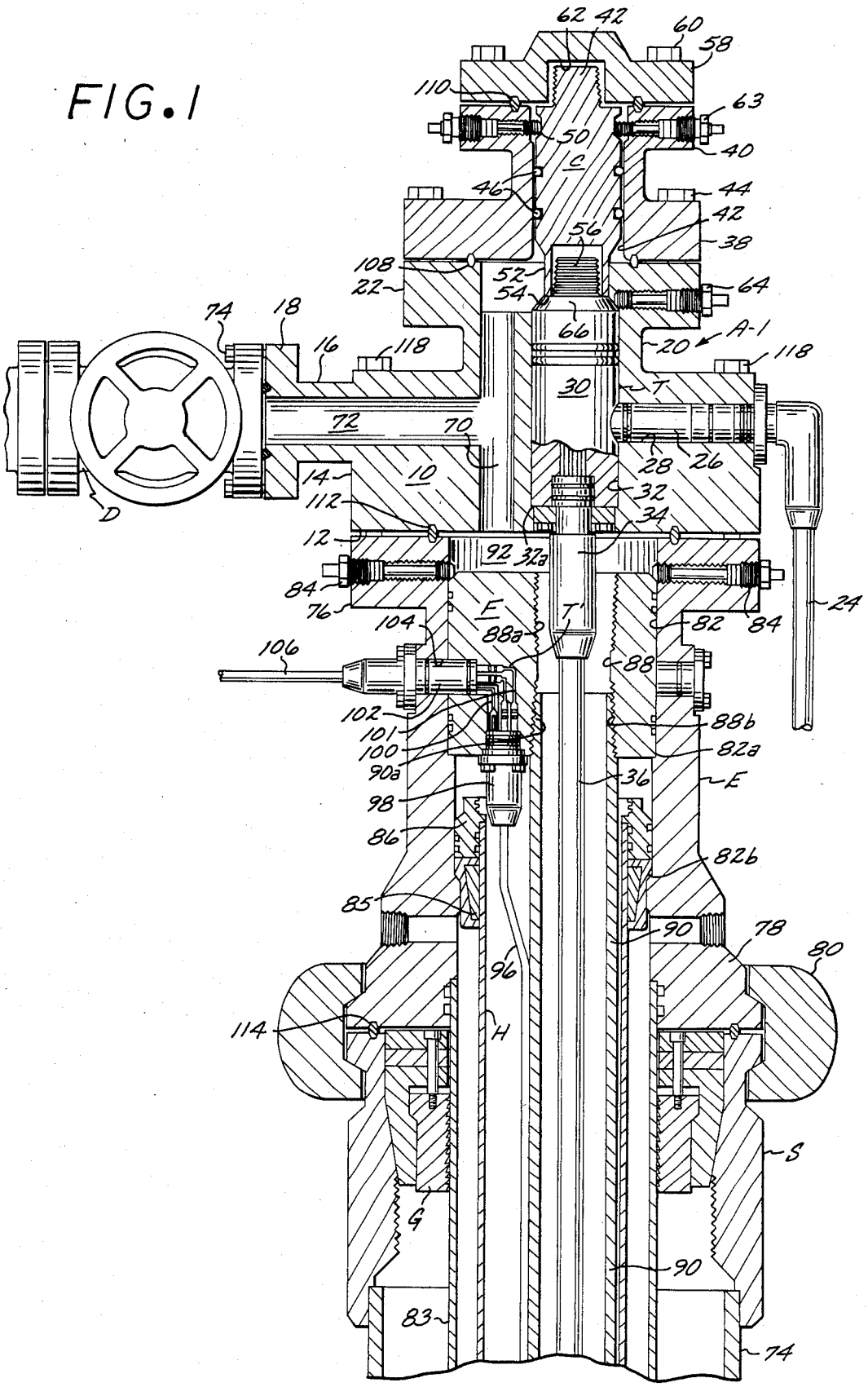
FIG. 1 is a vertical cross sectional view of a first form of diversionary spool assembly mounted on a unitized well head which in turn is secured to a casing head of a well, and is capable of supplying electric power and pressurized fluids for down hole purposes.
Figure 2:
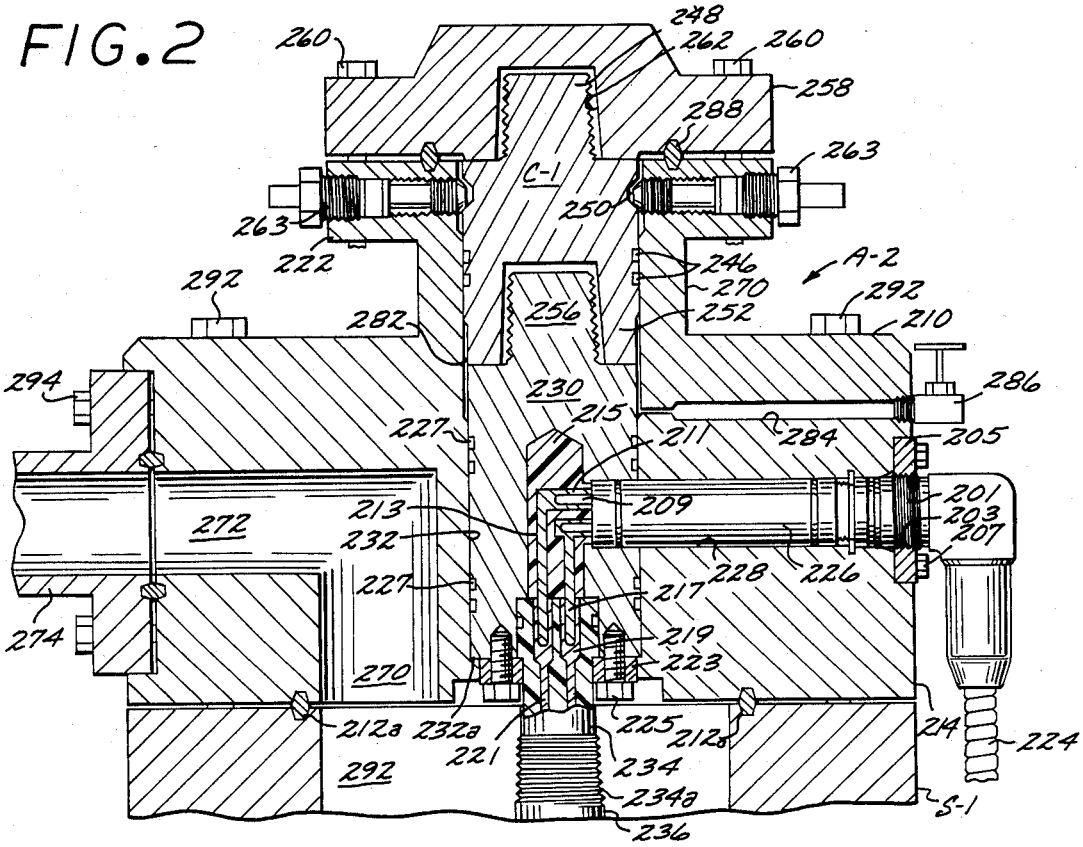
FIG. 2 is a vertical cross sectional view of a second form of diversionary spool assembly capable of supplying electric power for downhole purposes.
Figure 3:
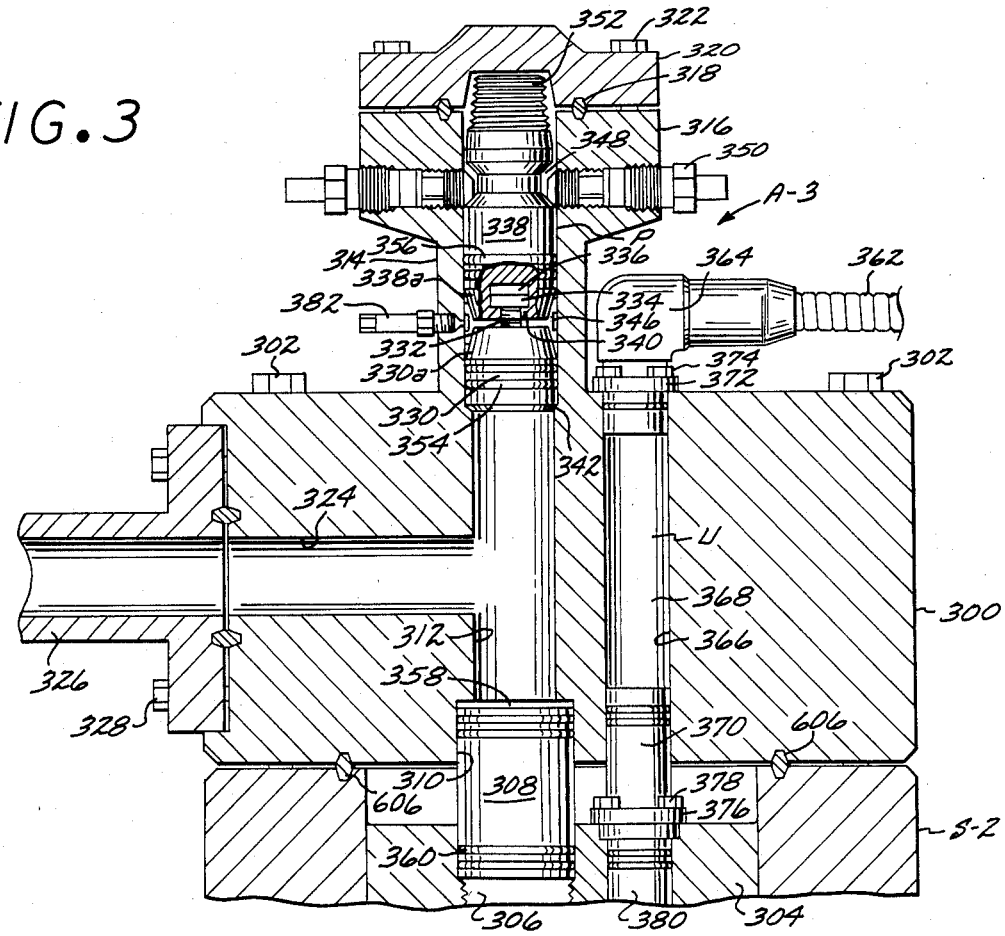
FIG. 3 is a vertical cross sectional view of a third form of diversionary spool assembly that serves the same function as the second form of the invention.

The invention as illustrated in FIGS. 1 to 3 is a diversionary spool assembly that is so operatively connected to a well head that fluid pumped upwardly through a tubing string by a submersible pump may be controlled by a valved outlet, and the diversionary spool assembly also capable of supplying electrical communication between an electric power supplying cable disposed exteriorly of the assembly and an electric power receiving cable that extends downwardly in the bore hole of the well and is also capable of supplying pressurized fluids for down hole purposes. The diversionary spool assembly when the occasion so requires is capable of having a christmans tree array of valves removably secured thereto for maintenance and remedial work to be performed on the well.

The invention as illustrated in FIGS. 4 to 7 is a diversionary spool assembly that is operatively connected to the casing head of a flowing well to not only control the rate of fluid flow from the well, but to permit a christmas tree array of valves to be removably mounted on the well to permit remedial and maintenance work to be performed on the latter when the occassion so requires.

Figure 8:
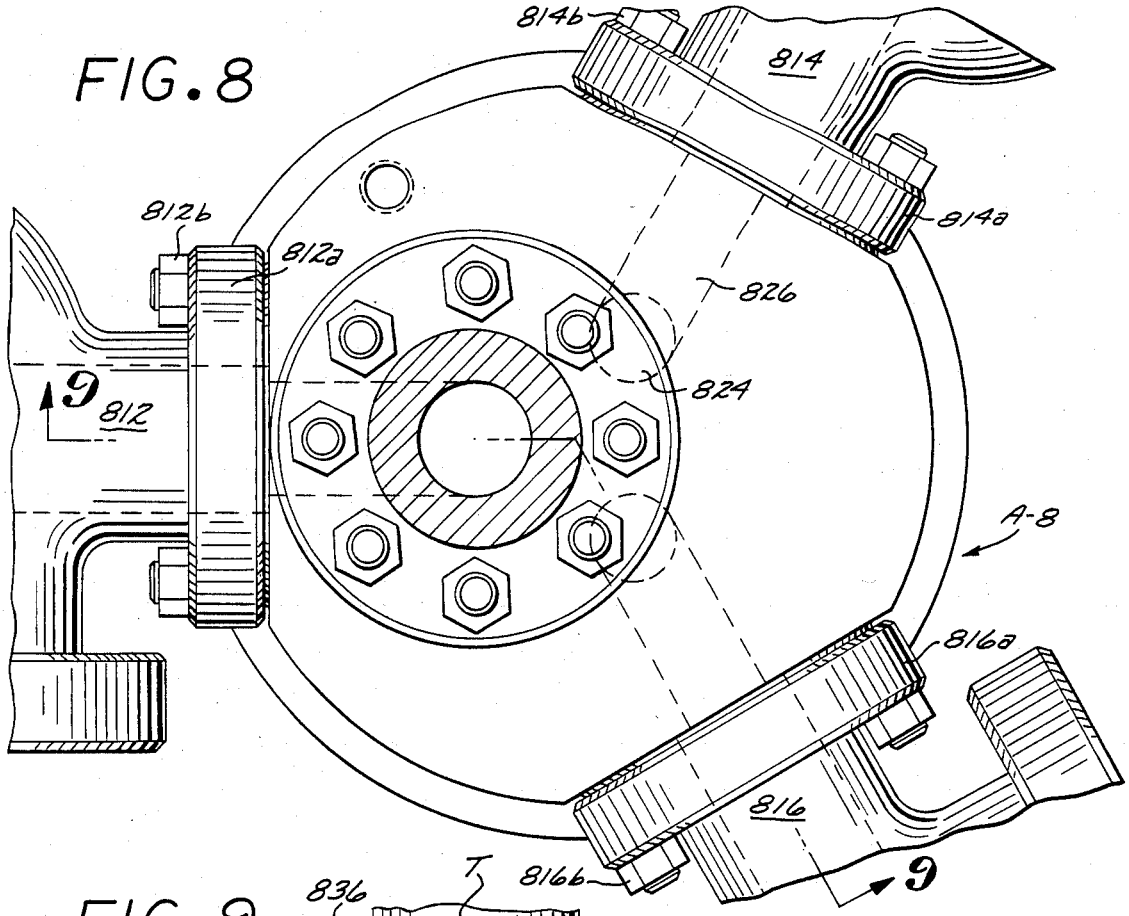
FIG. 8 is a top plan view of an eighth form of diversionary spool assembly for use on a hydraulically operated well.
Figure 9:
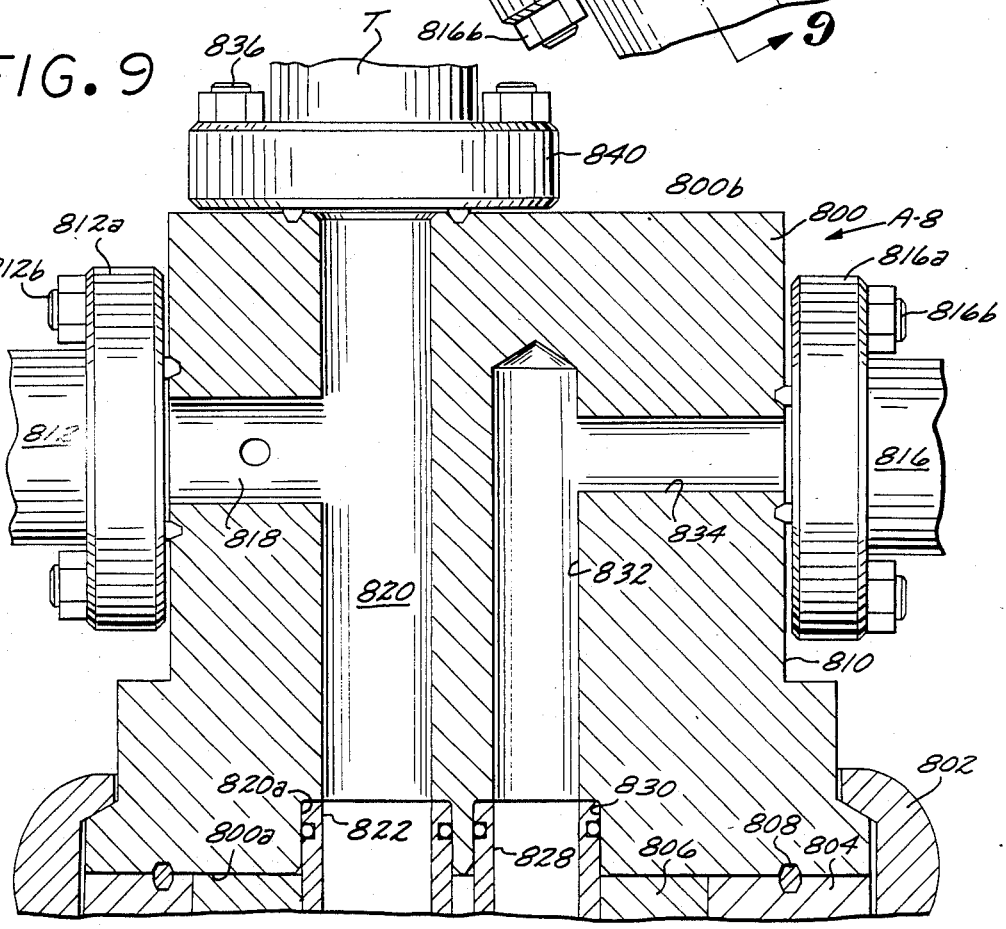
FIG. 9 is a vertical cross sectional view of the invention shown in FIG. 8 taken on line 9-9 of the latter.

The invention as shown in Figs.8 and 9 is a diversionary spool assembly that has the operational advantages previously mentioned, and is adapted for use on a hydraulically operated well.

DESCRIPTION OF THE PREFERRED EMBODIMENTS

A first form A-1 of the diversionary spool assembly is shown in FIG. 1 that is illustrated as being defined by a generally cylindrical rigid body 10 that has a flat lower surface 12, sidewall 14, a laterally extending tubular neck 16 for production fluid discharge and that terminates in a flange 18, and an upwardly extending tubular neck 20 that has a flange 22 on the upper end thereof.

An electrical power supply cable 24 is connected to a first electrical conducting cartridge 26 that is removably and sealing disposed in a lateral passage 28 in body 10 and in removable electrical communication with a second electrical conducting cartridge 30. The second cartridge 30 is removably supported in a vertical first passage 32 in body 10, and removably connected to an electrtical conducting connector 34 from which an electic power receiving cable 36 extends downwardly to an electrically driven submersible pump of a type that is commercially available (not shown) and that may be supported in the bore hole by the cable.

The first and second cartridges 26 and 30 and connector 34 provide an electrical conducting assembly T that is of the structure described and illustrated in detail in my U.S. Pat. No. 4,491,176 entitled "Power Supplying Well Head Assembly" that issued on Jan. 1, 1985.

A plug supporting spool B includes a lower flange 38 and upper flange 40, with a vertically extending passage 42 being formed in the spool that is in vertical alignment with the first passage 32 as may be seen in FIG. 1. Lower flange 38 is removably secured to flange 22 by bolts 44. A plug C having circumferentially sealing rings 46 thereon is removably supported in passage 42.

Plug C includes an upwardly disposed threaded extension 48, a recessed side portion 50, and a tubular shell 52 that bears against a portion 54 of second cartridge 30. Second cartridge 30 includes an upwardly projecting threaded extension 56.

Upper flange 40 has a bonnet 58 removably secured thereto by bolts 60. Bonnet 58 has an upwardly extending cavity 62 into which threaded extension 48 projects. Upper flange 40 supports screws 63 that bear against recessed portion 50 to prevent upward movement of plug C. Flange 22 supports screws 64 that bear against a tapered portion 66 of second cartridge 30, and that serve to force second cartridge 30 into sealing contact with a shoulder 32*a* in passage 32 as shown in FIG. 1.

Body 10 has a vertically extending, fluid conducting passage 70 therein that communicates with a lateral passage 72 in neck 16. A flanged fluid control valve D is removably mounted on flange 18 by bolts 74.

The diversionary spool assembly A-1 is illustrated in FIG. 1 as secured to the upper end of a unitized well head E that in turn is mounted on a casing head S secured to the upper end of a surface string of casing 74. Unitized well head E is of tubular shape and includes an upper ring shaped flange 76 and a lower flange 78 that by clamp means 80 is secured to the upper end of casing head S.

Well head E has a vertically extending passage 82 therein in which upper and lower body shoulders 82*a* and 82*b* are defined. A generally cylindrical tubing hanger F is removably disposed in passage 82 and rests on upper body shoulder 82*a*. Screws 84 are rotatably supported by upper flange 76 and removably engage tubing hanger F to prevent undesired upward movement thereof .An intermediate casing string 83 has the upper end portion landed in a conventional slip assembly G supported in casing head S.

An inner string of casing H extends downwardly to the production zone(not shown) and has the upper end landed in a slip assembly 85 supported on body shoulder 82*b*. A sealing ring assembly 86 is in sealing engagement with a surface portion of well head E that defines passage 82 and the outer surface of casing H.

Tubing hanger F has a vertically extending bore 88 therein that has upper and lower threaded portions 88*a* and 88*b*. Lower threaded portion 88*b* engages and supports a threaded end portion 90*a* of a downwardly extending tubing string 90 that on the lower end is in fluid communication with an electric powered submersible pump (not shown). Fluid discharge from the pump flows upwardly through tubing 90, passage 88, a space 92 between tubing hanger F and body 10, and passages 70 and 72 to valve D which may be manipulated to control the rate of fluid flow.

Pressurized fluids and auxillary electric power to operate down hole equipment (not shown) may be supplied to a concuit 96 that extends downwardly in the well from a connector 98 that is removably secured to a second cartridge 100 that in turn is in removable engagement with a first cartridge 102 mounted in a transverse bore 104 in well head E.

Pressurized fluids and auxillary electric power is supplied to first cartridge 104 by a conduit 106 that contains pressurized fluid conducting lines and an auxillary electric power line (not shown). A portion of the conductors in first cartridge 102, second cartridge 100, and connectore 98 are hollow to permit pressurized fluid flow from conduit 106 to conduit 96. First cartridge 102, second cartridge 100 and connector 98 comprise an assembly T' that is of the same structure as assembly T, other than that a portion of the conductors designated 101 are hollow.

A sealing ring 108 is disposed between flanges 30 and 22, and a sealing ring 110 is situated between bonnet 58 and flange 40. Flange 14 and flange 76 have a sealing ring 112 disposed therebetween. Also, flange 78 and casing head S have a sealing ring 114 disposed therebetween.

The flange 40 and the spacing of the bolts 60 is such that when the bonnet 58 is removed, the anchor flange of a conventional present day christmas tree array of valves (not shown) may be secured to flange 40 by use of the bolts 60.

After the bonnet 58 is removed from flange 40, and after the christmas tree array of valves (not shown) is secured thereto, the screws 62 are loosened and the threaded extension 48 of plug C is engaged by a suitable tool (not shown). Plug C may now be lifted upwardly and outwardly from spool B. Prior to the removal of the bonnet 58 the flow of electric power to the submersible pump (not shown) is terminated.

The next step is to move the first cartridge 26 outwardly out of engagement with the second cartridge 30. The threaded extension 56 of second cartridge 30 may now be engaged by a suitable tool (not shown)to move the second cartridge 30, connector 34, cable 36, and the submersible pump (not shown) upwardly and out of the diversionary spool assembly A-1. The christman tree array of valves (not shown) may now have the anchor flange thereof (not shown) removabvly secured to flange 40 by the bolts 60 to permit remedial and maintenance work to be performed on the well.

Should it be desired to remove the tubing hanger F and tubing string 90 from the well, the bolts 118 and 74 are loosened to permit separation of diversionary spool assembly A-1 from well head E, and flanges 18 and 74 from one another.First cartridge 102 is now moved outwardly from engagement with second cartridge 100. Threaded portion 88*a* of bore 88 is engaged by a suitable threaded tool (not shown) and the tubing hanger F and desired portion of tubing string 90 lifted upwardly above the well head E. When the desired maintenance work has been performed, the above described operation is reversed and the well returned to production.

From the above description it will be seen that when each of the wells in a group thereof is equiped with a diversionary spool assembly A-1, only a single working christmas tree array of valves is required to permit maintenance to be performed on the wells, all at a great financial saving to the operator the wells, as the diversionary spool assemblies A-1 are far less expensive than the conventional christmas tree array of valves previously provided on the wells.

A diversionary spool assembly A-2 is shown in FIG. 2 that has the same operational advantages as the diversionary spool assembly A-1, but is secured directly to a casing head S-1 that supports a tubing hanger(not shown) of the same general structure as the tubing hanger F illustrated in FIG. 1. The diversionary spool assembly A-2 includes a generally cylindrical body 210 that has a flat lower surface 212 and a side wall 214, as well as an upwardly extending tubular neck 220. The tubular neck 220 develops on the upper end thereof into a flange 222 that is a companion flange to the anchor flange (not shown) of a conventional present day christmas tree array of valves.

An electric power supply cable 224 is connected to a first electrical conducting cartridge 226 that is slidably and sealingly mounted in a lateral passage 228 defined in body 210. First electrical conducting cartridge 226 is in removable and electical engagement with a second electrical conducting cartridge 230.

Second cartridge 230 is slidably and removably mounted in a vertical first passage 232 that has a shoulder 232*a* that acts as a stop for the lower portion of the second cartridge.

An electrical conducting connector 234 removably engages the lower portion of the second cartridge 230. Connector 234 supports an electric power supplying cable 236 that extends downwardly in the well to engage an electrically operated submersible pump (not shown) or for any other desired purpose.

First cartridge 226 has threads 201 thereon that are engaged by a threaded bore 203 in a plate 205 that is removably secured to body 210 by bolts 207. First cartridge 226 has electrical conducting prongs 209 on the inner end thereof that removably engage electrical conducting sockets 211 secured to electrical conductors 213, which conductors are supported in a core of electrical insulating material in second cartridge 230.

Electrical conductors 213 on their lower end portions define downwardly extending prongs 217 that removably and slidably engage the electrical conducting sockets 219 connected to electrical conducting conductors 221 that extend downwardly through cable 236. A ring shaped plate 223 engages a shouldered portion of second cartridge 230. Bolts 225 extend through plate 223 and serve to removably hold plate 223 in a supporting position for a connector 234.

Sealing rings 227 are mounted on second cartridge 230 above and below first cartridge 226 and are in pressure contact with the portion of body 210 that defines first passage 232. Cable 236 extends downwardly through a tubing hanger(not shown),and a tubing string (not shown) in the same manner as the cable 36 does and as as illustrated in FIG. 1. Fluid discharges upwardly in the well to enter a space 292 that is comparable to space 92 previously described ,and then enters second passages 270 and 272 to exit through a control valve 274.

Second cartridge 230 has an upwardly extending threaded projection 256 which may be removably engaged by a suitable tool (not shown) as will later be explained.

A plug C-1 provided with external circumferentially extending sealing rings 246 is slidably mounted in first passage 232 and seals with the surface portion of body 210 defining the passage. Plug C-1 has an upper externally threaded portion 248 that may be removably engaged by a suitable tool (not shown) to lift the plug C-1 from the passage 232. Plug C-1 includes a recessed upper side portion 250 and a tubular shell 252 that extends downwardly into abutting contact with second cartridge 250. Extension 256 projects upwardly into the confines of tubular shell 252 Screws 263 are threadedly mounted in tapped transverse passages defined in flange 222 and when tightened engage recessed portion 250 to removably lock plug C-1 in passage 232. A bonnet 258 is removably secured to flange 222 by bolts 260, with the bonnet having an upwardly extending cavity 262 into which extension 248 projects.

The lower external portion of plug C-1 and upper external portion of second cartridge 230 are slightly recessed and cooperate to define a circumferentially extending space 282 with the sidewall defining first passage 232.. Space 282 is in communication with a small diameter lateral passage 284 formed in body 210. A normally closed small, hand operated valve 286 is mounted on body 210 and in communication with passage 284. By opening valve 286 it may be determined whether high pressure gas from the well is leaking upwardly past the sealing rings 227 to enter space 282 and exert upward pressure on plug C-1. A sealing ring 288 is situated between bonnet 258 and flange 222. Connector 284 has external threads 234a defined thereon.

The diversionary spool assembly A-2 is used by first shutting down the well and then moving first cartridge 226 out of engagement with second cartridge 230. Bonnet 258 is removed from flange 222, and screws 263 are then loosened, and threaded extension 248 is engaged by a suitable tool (not shown), with plug C-1 then being lifted out of first passage 232.

Threaded extension 256 is now engaged by a suitable tool (not shown), and second cartridge 230, connector 234, and a portion of cable 236 lifted above body 210 .If the cable supports a submersible pump (not shown) the latter will be moved upwardly with the cable. When the tubing string (not shown )has bveen closed, the anchor flange (not shown) of the christmans tree array of valves is removably secured to flange 222 by bolts 260 to permit remedial and maintenance to be performed on the well.

When the work is completed, the above described sequence of steps is reversed, and the well placed in operation. Body 210 is removably secured to to casing head S-1 by bolts 292. Bolts 294 secure valve 274 to body 210. A sealing ring 212 is disposed between body 210 and casing head S-1.

A third form of diversionary spool assembly is shown in FIG. 3 that is adapted to supply electric power for down hole use, and is capable of having a present day, conventional christmas tree array of valves removably mounted thereon for remedial and maintenance purposes. The third form A-3 includes a generally cylindrical body 300 that by bolts 302 is removably secured to a casing head S-2, which casing head supports a tubing hanger 304. The tubing hanger 304 has a fluid conducting bore 306 therein from which a tubular fluid conductor 308 extends upwardly to removably engage the lower portion 310 of a first vertical passage 312 that extends upwardly in body 300.

First passage 312 extends upwardly through a tubular neck 314 that has a flange 316 on the upper end thereof that is a companion flange to the anchor flange (not shown) on a present day christmas tree array of valves. Flange 316 supports a sealing ring 318 that is in abutting contact with a bonnet 320. The bonnet 320 is secured to flange by bolts 322.. When the bonnet is removed from bolts 322, the bolts are used to removably secure the anchor flange to the flange 316.

A second passage 324 is defined in body 300, which second passage is laterally disposed and in communication with first passage 312. A valve 326 is removably secured to body 300 by bolts 328 and in fluid communication with second passage 324

A plug P is removably mounted in the upper portion of first passage 312 within tubular neck 314. Plug P includes a lower neck 314. Plug P includes a lower portion 330 that has a stem 332 projecting upwardly therefrom that supports an enlarged head 334. Head 334 is slidably movable in an elongate vertical space 336 in an upper plug portion 338, and is prevented from moving downwardly out of space 336 by a stop 340 that forms a part of upper plug poprtion 338.

Lower plug portion 330 and upper portion 338 have adjacent oppositely disposed tapered surfaces 330*a* and 338*a*. Lower plug portion 330 rests on a shoulder 342 defined in first passage 312. A radially expandable metal band 344 is situated between lower and upper portions 330 and 338 that is expanded into a metal to metal seal with the portion of body 300 that defines first passage 312 when upper portion 338 is moved downwardly and tapered surfaces 330*a* and 338*a* are forced into the interior of the band.

Upper plug portion 338 includes a circumferentially extending recessed portion 348 that is transversely aligned with screws 350 threadedoly supported in flange 316. When the plug portion 338 is moved downwardly suffeciently to expand band 346 into the previously identified metal to metal seal, the screws 350 are rotated to move inwardly to engage the recessed portion 348, and lock the plug P in a sealing position in first passage 312.

The upper plug portion 338 has threads 352 thereon above recessed portion 348, which threads are used to retrieve plug P from first passage 312 with a suitable tool (not shown) after bonnet 320 is removed from the neck 314 and screws 350 are disengaged from recessed portion 348.

Lower plug portion 320 and upper plug portion 338 support sealing rings 354 and 354 that sealingly engage the material that defines first passage 312 in tubular neck 314. Tubular conductor 308 supports upper and lower sealing rings 358 and 360 that engage body 300 and tubing hanger 304.

Electric power for down hole purposes is supplied through body 300 by an electrical conducting unit U that is illustrated and described in detail in my co-pending application Ser. No. 666,291, filed Oct. 29, 1984, entitled "Top Entry Electrical Transmission Assembly for Submersible Pump".

The unit U includes an electric power supply cable 362 that is connected to a first cartridge 364 that extends downwardly in a bore 366 in body 300, which bore contains an intermediate cartridge 368 that is removably engaged by the first cartridge. A second electrical conducting cartridge 370 extends upwardly from tubing hanger 304 and removably engages the intermediate cartridge 368. First cartridge 364 has a plate 372 secured thereto which by bolts 374 is removably affixed to body 300. Similarly, second cartridge 370 has a plate 376 affixed thereto which by bolts 378 is secured to tubing hanger 304. Second cartridge 370 is in electrical communication with a cartridge 380 supported in tubing hanger 304.

Should the metal to metal seal fail, a sealing compound (not shown) may be injected into the space between the upper and lower plug portions 338 and 330 through a normally closed tube 382. A sealing ring 384 is disposed between body 300 and casing head S-2

By loosening the screws 350 and removing bolts 322 and bonnet 320, the threads 352 may be engaged by a suitable tool(not shown), and the plug P removed. The anchor flange (not shown) of a conventional present day christmas tree array of valves may now be mounted on flange 316. The anchor flange is removably secured to flange 316 by bolts 322 to permit remedial and maintenance work to be performed on the well.

Figure 4:
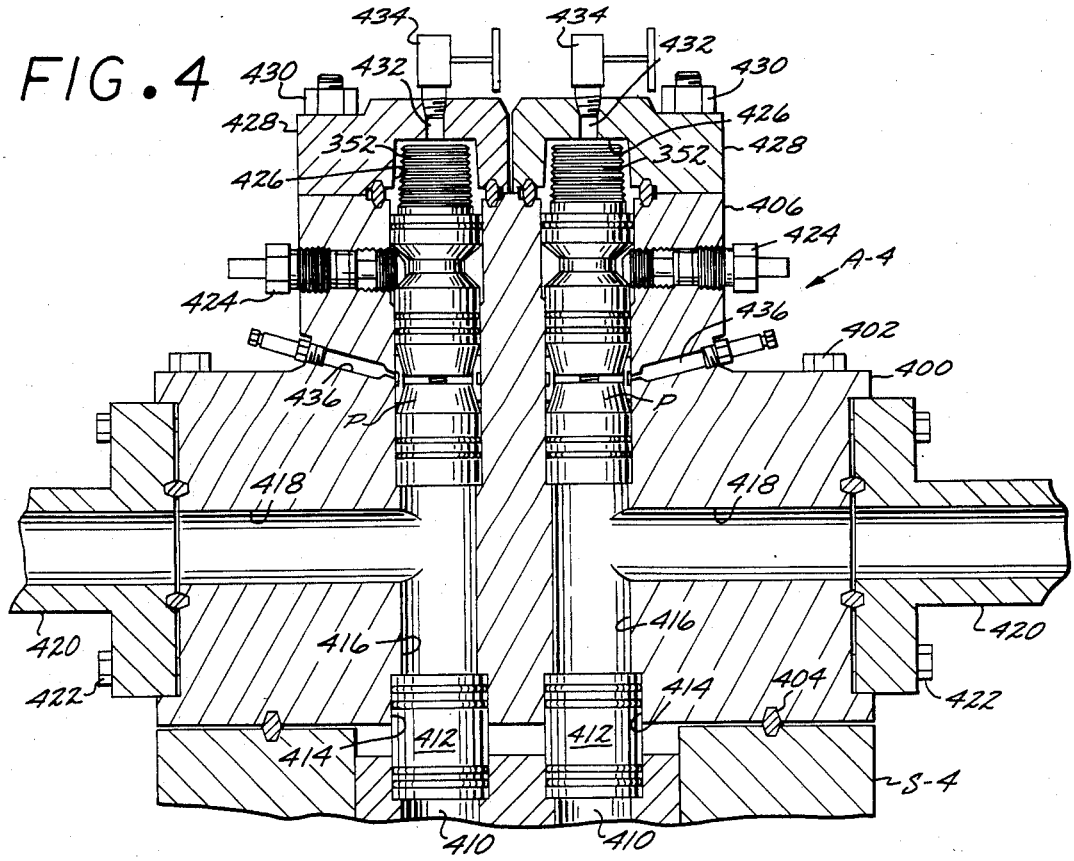
FIG. 4 is a vertical cross sectional view of a fourth form of diversionary spool assembly for use on either a dual injection or dual production well.

A diversionary spool assembly A-4 is shown in FIG. 4 for use on a dual injection or dual production well. The assembly A-4 includes a generally cylindrical body 400 that by bolts 402 is secured to a casing head S-4 as shown in FIG. 4, with the body and casing head having a sealing ring 404 disposed therebetween. Body 400 includes an upwardly extending portion 406.

Casing head S-4 supports a tubing hanger 408 that has a pair of laterally spaced, vertically extending bores 410 therein that are engaged by a pair of vertical, upwardly extending fluid conducting members 412. The tubular members 412 sealingly and removably engage upwardly extending recesses 414 in body 400 from which a pair of fluid passages 416 extend upwardly through the body and upper portion 406.

A pair of lateral second passages 418 are defined in body 400 in fluid communication withthe first passages 416 a pair of valves 420 are secured to body 400 by bolts 422, and are in fluid communication with second passages 418.

A pair of plugs P of the structure described in detail with reference to the third form A-3 are disposed in the upper portions of the pair of first passages 416, and removably held in place therein by screws 424. The threads 352 on plug P are disposed in a pair of cavities 426 that extend upwardly in a pair of bonnets 428 that are removably secured to upper body portion 406 by bolts 430.

Each bonnet has a vertical bore 432 therein in communication with a cavity 426, as well as a small valve 434 that is normally closed. By opening a valve 434 a determination may be made as to whether high pressure gas is leaking upwardly past one of the plugs P. Should a leak be found, a sealing compound (not shown) may be injected through either of two normally closed tubes 436 to seal the leaking plug P.

When the appropriate screw 424 and bolts 430 are removed one of the bonnets 428 may be separated from upper body portion 406 and a plug P removed, to permit an anchor flange (not shown) of a christmas tree array of valves (not shown) to be removably mounted on the upper body portion 406 by use of bolts 430.

When the christmas tree array of valves is so mounted maintenance and remedial work may be performed on the well..When maintenance and remedial work is not being performed on the well, the diversionary spool assembly A-4 is used to produce fluid from a well in a customary present day method that is well understood in oil field operation and need not be explained.

Figure 5:
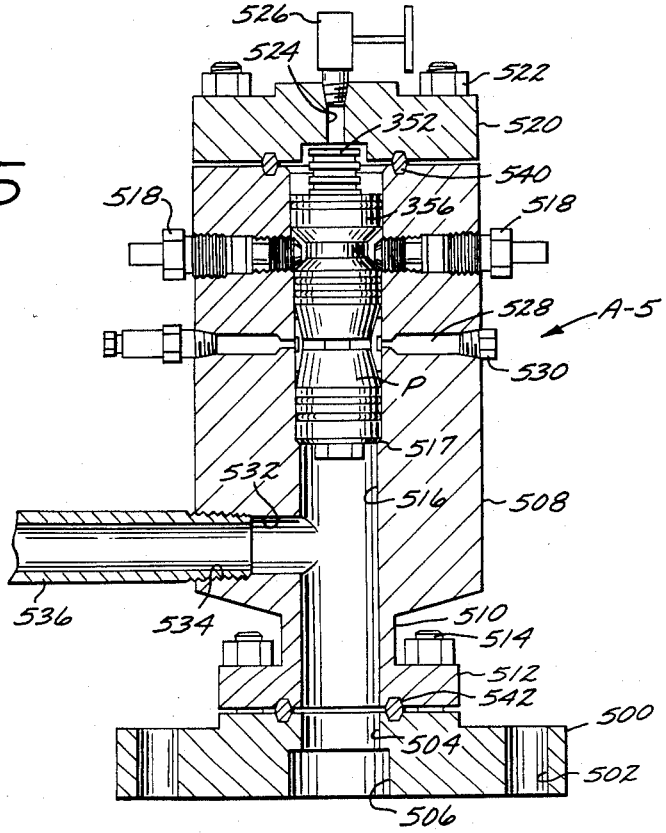
FIG. 5 is a vertical cross sectional view of a fifth form of diversionary spool assembly for use on an artesian well.

A fifth form of diversionary spool assembly A-5 is shown in FIG. 5 for use on an artesian well and that includes a first flange 500 in which a circle of bolt holes 502 is defined, and through which bolt holes bolts (not shown) may be extended to secure the first flange to casing head (not shown). First flange 500 has a centered bore 504 therein that on the lower end develops into an enlarged portion 506 that is slidably and sealingly engaged by a tubular fluid conductor (not shown) that is of the structure of conductor 412 shown in FIG. 4.

Fifth form of diversionary spool assembly A-5 includes an elongate, vertical, generally cylindrical body 508 that has a downwardly extending tubular neck 510 that develops into a second flange 512 that is removably affixed to first flange 500 by bolts 514. A first passage 516 extends upwardly in body 508 and is vertically aligned with bore 504.

A plug P of the structure and operation previously described is removably and sealingly mounted in first passage 516, and has the lower portion thereof of abutting contact with a shoulder 517. Plug P is removably held in a metal to metal sealing position by screws 518 that are rotatably supported by body 508. A bonnet 520 is removably secured to the upper end of body 508 by bolts 522, with the bonnet having a centered vertical bore 524 therein that is in communication with a normally closed, small, hand operated valve 526. By opening valve 526 a determination may be made as to whether high pressure gas from a well is leaking upwardly in first pasage 516 past plug P. A pair of lateral, small diameter bores 528 are formed in body 508 that are normally closed by threaded caps 530. By removing caps 530 sealing fluid (not shown) can be injected into first passage 516 to seal with plug P should the latter found to be leaking. Fluid flows upwardly from the well through first passage 516 and then through a lateral second passage 532 to enter a pipe 536 that directs the fluid to a desired destination.

By removing bonnet 520 a present day christmas tree array of valves (not shown) may be secured to the upper end of body 508 by use of bolts 522 for maintenance and remedial work to be performed on the well after plug P has been removed from the first passage 516. Sealing rings 540 and 542 are disposed between bonnet 520 and body 506 and between second flange 512 and first flange 500.

Figure 6:
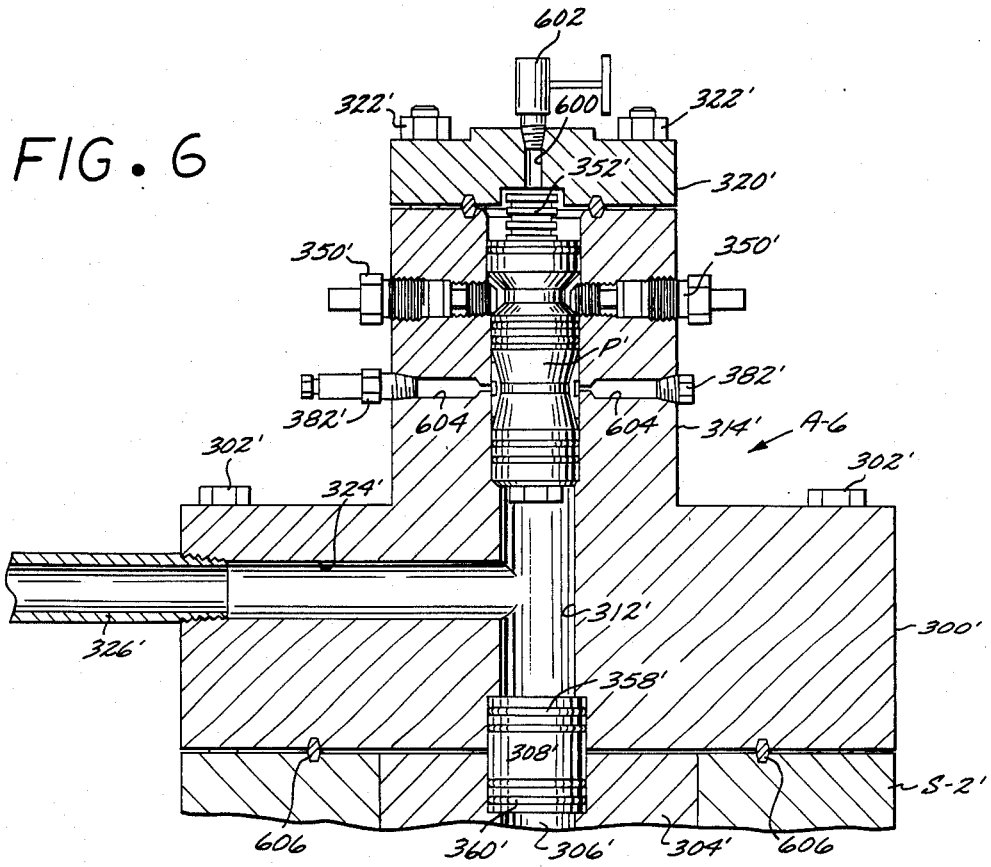
FIGS. 6 and 7 are vertical cross sectional views of sixth and seventh forms of diversionary spool assemblies for use on artesian wells.

A sixth form A-6 of a diversionary spool assembly A-6 is shown in FIG. 6 for use on an artesian well, which third form is of substantially the same structure as the third form A-3, other than the sixth form does not include electrical conducting means. Parts of the third form of assembly A-6 that are common to the third form A-3 are identified by the same numerals previously used but with primes being added thereto.

Bonnet 320' has a centered bore 600 therein that is in communication with first passage 312' above plug P'. A small normally closed valve 602 is in communication with bore 600. By opening valve 602 a determination may be made as to whether high pressure gas is leaking upwardly in first passage 312' past plug P. If such leakage is occurring screws 382' are removed and a sealing compound (not shown) injected through lateral passages 604 to seal with plug P'. Body 300' and casing head S-2' have a sealing ring 606 disposed therebetween, and such a sealing ring is also used on the third form A-3 of the assembly. The sixth form A-6 is used in the same manner as third form A-3 and serves the same purpose other than that the sixth form cannot supply down hole electric power.

Figure 7:
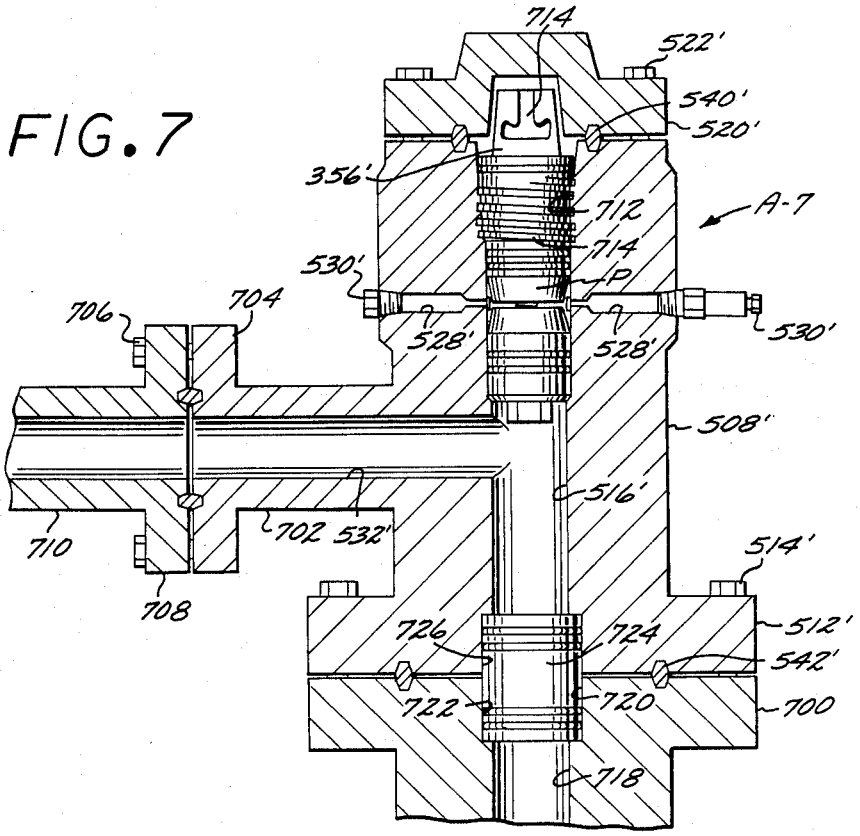

The seventh form of diversionary spool assembly shown in FIG. 7 is similar to the fifth form A-5. Parts of the seventh form A-7 that are common to the fifth form A-5 are identified by the same numerals previously used but with primes being added thereto.

Flange 512' is by bolts 514' secured to the top of a tubing hanger 700 that is supported in a casing head. A tubular neck 702 extends outwardly from body 508' and through which passage 532' extends. Tubular neck 702 has a second flange 704 on the outer end thereof, which flange by bolts 706 is secured to a flange 708 of a valve 710 that is but partially shown..

The upper portion of first passage 516' has threads 712 formed in the portion of body 508' that defines the sidewall of the passage. The upper portion 356' of plug P' has threads 714 defined thereon which when the upper portion is rotated in an appropriate direction move the upper portion downwardly to effect a metal to metal seal as previously described.. When bonnet 520' is removed a J slot 714 may be removably engaged by a suitable tool (not shown) to rotate upper plug portion 356, as well as lift plug P' from first passage 516' when threads 712 and 714 are disengaged. Tubing hanger 700 has an upwardly extending passage 718 therein that includes an upper enlarged portion 720 that is sealingly engaged by resilient sealing rings 722 on a tubular fluid conductor 724 that extends upwardly into an enlarged cylindrical portion 726 defined in body 508' that is in communication with passage 516' and in vertical alignment therewith.

Fluid conductor 724 has resilient sealing rings 728 thereon that seal with cylindrical portion 726. The seventh form of assembly A-7 operates in substantially the same manner as in the fifth form A-5 and serves the same purpose.

An eighth form of diversionary spool assembly A-8 is shown in FIGS. 8 and 9 which is used on a hydraulically operated well.. Eighth form A-8 includes a generally cylindrical body 800 that by a clamp 802 is secured to a casing head 804 that supports a tubing hanger 806. A sealing ring 808 is disposed between body 800 and casing head 804. Body 800 has a cylindrical side surface 810.

Eighth form A-8 includes a power fluid inlet valve 812, power fluid return valve 814, and fluid production control valve 816, which valves include flanges **812*a*, 814*a*, and 816*a*. Bolts 812*b*, 814*b*, and 816*b* removably secure flanges 812*a*, 814*a*, and 816*a* to body 800. First valve 812 is in communication with a first lateral passage 818 that communicates with a first vertical passage 820 that extends from the bottom 800*a* to the top 800*b* of body 800. First vertical passage 820 has a lower cylindrical portion 820*a* of increased diameter that is sealingly engaged by a tubular fluid conductor 822 that is mounted in tubing hanger 806 and in communication with a tubing string (not shown) that extends downwardly therefrom. Power fluid discharged under pressure into first passage 820 is returned through a second passage 824 and second lateral passage 826 to second valve 814** for recirculation.

Production fluid flows upwardly through a passage (not shown) in tubing hanger 806 and through a tubular fluid conductor 828 that removably and sealingly engages a cylindrical recess 830 that extends upwardly from bottom **800*a* to communmicate with a third vertical passage 832. Third passage 832 is in communication with a lateral passage 834 that leads to valve 816**.

In normal operation a bonnet (not shown) will be secured to top **800*b* by bolts to close the upper end of first passage 820. When maintenance or remedial work is to be performed on the well, the well is shut down, the bonnet removed, and a conventional present day christmas tree array of valves (partially shown) that includes an anchor flange 840 removably secured to body 800 by bolts 836. Maintenance and remedial work may now be carried out on the well, with access to the well being through first passage 820. When the work is completed the bonnet (not shown) is caused to replace anchor flange 840, with the bonnet secured to body 800 by bolts 806**.

The use and operation of the different forms of diversionary spool assemblies has been described previously in detail and need not be repeated.

I claim:

1. In combination with an oil and gas well that includes a casing head from which a string of tubing extends downwardly in a bore hole to a fluid producing zone, a diversionary spool assembly situated in a fixed position relative said well head to control fluid flow from said well and also serve as a temporary mounting for a Christmas tree array of valves when maintenance work is to be performed on said well, said array of valves including an anchor flange on a lower end thereof, said diversionary spool assembly including;

a. a rigid body mounted on said well head, said body having a top surface, and a plurality of passages therein, a first of said passages extending upwardly through said body and vertically aligned with said tubing string, said first passage having an upper end portion, and a second passage through which fluid flows;

b. valve means for controlling the flow of fluid through said second passage;

c, a plug removably and sealingly mounted in said upper end portion, said plug including an upper engageable portion;

d. first movable means on said body for removably engaging said plug to maintain said plug at a fixed position in said first passage;

e. a bonnet mounted on said top surface of said body that seals said upper end portion of said first passage; and, f. second means for removably securing said bonnet to said body that is also capable of securing said anchor flange of said christmans tree array of valves to said body after said bonnet is removed from the latter, said spool assembly when mounted on said well head capable of having oil and gas produced from said well, and said spool assembly permitting access to said well through said tubing string for maintenance work to be performed on said well by removing said bonnet from said body and thereafter securing said anchor flange of said array of valves to said body by said second means, moving said first means to disengage from said plug, engaging said engageable portion of said plug and moving said plug upwardly and outwardly from said first passage through said array of valves, performing the maintenance work, and thereafter reversing the above described procedure to return the diversionary spool assembly to an oil and gas producing condition.

2. A diversionary spool assembly as defined in claim 1 in which said oil and gas well includes an electrically driven pump disposed therein below said diversionary spool and in fluid communication with said tubing string, said diversionary spool assembly further including;

g. electrical conducting means at least partially disposed within said body, said electrical conducting means including an electric power receiving portion and an electric power supply portion;

h. electric power means at least partially external of said body that removably engage said electric power receiving portion; and i. elongate electrical power transmitting means that engage said electric power supply portion and extend downwardly in said well to said electrically operated pump to energize the latter to discharge fluid upwardly through said tubing string and outwardly through said second passage.

3. A diversionary spool assembly as defined in claim 2 in which said electrical conducting means extends vertically through said body and tubing hanger, with said electric power receiving portion disposed above said body and said electric power supplying portion in electrical communication with said elongate electrical power transmitting means.

4. A diversionary spool assembly as defined in claim 1 in which said electric power means includes a first electrical conducting cartridge disposed in a lateral bore in said body and said electrical conducting means is a second electrical conducting cartridge disposed in said first passage, said second electrical conducting cartridge including an electrical power receiving portion and an electrical power supplying portion, with said first electrical conducting cartridge removably engaging said electric power receiving portion of said second cartridge, and said electric power supplying portion of said second cartridge in electrical communication with said elongate electrical power transmitting means.

5. A diversionary spool assembly as defined in claim 4 which in addition includes:

k. a connector secured to said elongate electrical power transmitting means that removably engages said electrical power supplying portion.

6. A diversionary spool assembly as defined in claim 4 which in addition includes:

k. sealing means on aid first electrical conducting cartridge that seal with said body to prevent entry of moisture from the ambient atmosphere through said lateral bore to said second electrical conducting cartridge to do possible damage thereto.

7. A diversionary spool assembly as defined in claim 5 which in addition includes:

l. sealing means on said connector that seal with said second electrical conducting cartridge to prevent gas and moisture from said well contacting said second electrical conducting cartridge to do possible damage thereto.

8. A diversionary spool assembly as defined in claim 1 in which said oil and gas well includes a hydraulically operated pump that is in communication with said tubing string and receives power fluid from said first passage, said second passage having well fluid discharged from said pump flow therethrough, and a third passage in said body through which power fluid discharged from said pump flows.

9. A diversionary spool assembly as defined in claim 1 in which said second passage is in communication with said first passage below said plug.

10. A diversionary spool assembly as defined in claim 1 in which said first passage has an intermediate positioned body shoulder therein, and said plug includes;

g. a lower portion in said first passage seated on said body shoulder;

h, an upper portion in said first passage and longitudinally movable relative thereto;

i. a ring shaped metal seal disposed between said upper and lower portions that is radially expandable into sealing contact with the portion of said body defining said first passage when said first portion is moved downwardly a predetermined distance in said first passage; and j. third means for removably holding said first portion in a fixed position relative said body after it has been moved downwardly said predetermined distance.

11. A diversionary spool assembly as defined in claim 1 in which said second means is a bonnet, and said third means are a plurality of bolts capable of removably securing either said bonnet or said anchor flange to said body to dispose said christmas tree array of valves above said body.

12. A diversionary spool assembly as defined in claim 1 in which said oil and gas well is either a dual production or dual injection well, and said diversionary spool assembly in addition including; a second tubular neck; second flange; second plug; second first means; and a second set of first and second passages that are arranged the same on said body as said first tubular neck, first flange, first plug; first means; and said first and second passages as described in claim 18.

13. In combination with a christmas tree array of valves that includes an anchor flange for supporting it in an upright position, a casing head, a tubing hanger operatively associated with said casing head, a tubing string that extends downwardly in an oil and gas well from said tubing hanger and in vertical alignment with a vertical bore in the latter, a diversionary spool assembly removably disposed in a fixed position above said casing head to control the flow of fluid from said well and to permit remedial and maintenance work to be performed on said well when said christmas tree array of valves is removably mounted on said diversionary spool assembly in vertical alignment with said bore, said diversionary spool assembly including;

a. a rigid body that has a top, bottom and sidewall, a first tubular neck that extends upwardly from said top, a first flange mounted on the upper extremity of said first tubular neck, which first flange is a companion flange to said anchor flange, and a plurality of passages in said body, with a first of said passages extending upwardly in vertical alignment with said body and first tubular neck and in communication with a second passage in said body that has a fluid inlet in communication with said first passage and a fluid outlet in said side of said body;

b. first means for supporting said body above said casing head, with said first passage in communication with said bore in said tubing hanger;

c. a first bonnet removably and sealingly mounted on said first flange;

d. a first plug sealingly and removably mounted in said first tubular neck below said first flange;

e first engageable means on said first plug for retrieving the latter;

f first movable means on said first tubular member for removably engaging said first plug to maintain said first plug at a fixed position in said first passage;

g first valve means for controlling the flow of fluid from said second passage; and h first second means for removably securing said first bonnet to said body that is also capable of securing said anchor flange of said Christmans tree array of valves to said body after said bonnet is removed from the latter, said spool assembly when mounted on said well head capable of having oil and gas produced from said well, and said spool assembly permitting access to said well through said tubing string for maintenance work to be performed on said well by removing said first bonnet from said body and thereafter securing said anchor flange of said array of valves to said body by said second means, moving said first means to disengage from said plug, engaging said engageable portion of said first plug and moving said first plug upwardly and outwardly from said first passage through said array of valves, performing said maintenance work, and thereafter reversing the above described procedure to return the diversionary spool assembly to an oil and gas producing condition.

14. A a diversionary spool assembly as defined in claim 13 which in addition includes a second set of elements that are duplicates of said first and second passages in said body, said first tubular neck, said first flange on said first tubular neck said first plug in said first tubular neck, said first bonnet removably and sealingly mounted on said first flange, said first means, and said second means for removably securing said first bonnet to said first flange as set forth in claim 14 to permit said diversionary spool assembly to be used on either a dual injection or dual production oil and gas well.

15. A diversionary spool assembly as defined in claim 13 which in addition includes;

i. third means for determining whether pressurized gas from said well has leaked upwardly past said plug in said first tubular neck.

* * * * *